United States Patent [19]

Brewer

[11] Patent Number: 5,071,327

[45] Date of Patent: Dec. 10, 1991

[54] TWO SPEED GEROTOR MOTOR WITH CENTRALLY LOCATED VALVE AND COMMUTATOR

[75] Inventor: Darrell W. Brewer, Sabattus, Me.

[73] Assignee: Parker Hannifin Corporation, Cleveland, Ohio

[21] Appl. No.: 606,655

[22] Filed: Oct. 31, 1990

[51] Int. Cl.[5] ..... F03C 2/08

[52] U.S. Cl. ..... 418/5; 418/60; 418/61.3

[58] Field of Search ..... 418/5, 60, 61.3

[56] References Cited

U.S. PATENT DOCUMENTS

| | | | |
|---|---|---|---|
| 3,778,198 | 12/1973 | Giversen | 418/61.3 |
| 3,892,503 | 7/1975 | Getman | 418/61.3 |
| 3,910,732 | 10/1975 | Lusztig | 418/61.3 |
| 3,944,378 | 3/1976 | McDermott | 418/61.3 |
| 4,480,971 | 11/1984 | Swedberg | 418/61.3 |
| 4,586,885 | 5/1986 | Middlekauff | 418/61.3 |
| 4,875,841 | 10/1989 | White, Jr. | 418/61.3 |

*Primary Examiner*—John J. Vrablik

*Attorney, Agent, or Firm*—Christopher H. Morgan

[57] ABSTRACT

This gerotor-type hydraulic motor operates at two speeds (low speed, high torque and high speed, low torque) at a given flow rate and pressure of driving hydraulic fluid. It includes first and second rotating power elements disposed along an axis. Between the first and second power elements are first and second commutators. Located between the two commutators is a valve piece which is an integral portion of the motor. The valve piece selectively directs fluid, either in parallel or in series, through the first and second commutators, respectively, to the first and second power elements. Preferably the valve piece includes a spool valve. Also preferably the valve piece includes inner and outer concentric galleries located on opposite sides of the spool valve.

3 Claims, 9 Drawing Sheets

TWO SPEED GEROTOR MOTOR WITH CENTRALLY LOCATED VALVE AND COMMUTATOR

BACKGROUND OF THE INVENTION

1. Field of the Invention

This invention relates in general to gerotor-type motors and more particularly to such motors capable of operating at two speeds.

2. Description of the Prior Art

Gerotor type pumps and motors are well known to those in the pump and motor art. They include a power element which has a lobed set of gears which, when rotating, form increasing and decreasing volume cavities therebetween. Gerotor type pumps and motors are shown in U.S. Pat. Nos. 4,501,536; 4,545,748; and 4,563,136.

Among the various gerotor-type motors are motors capable of operating at two speeds and torques at a given flow and pressure in the driving fluid. This allows both high speed, low torque and low speed, high torque motor operation. Generally these motors are constructed to operate at two speeds in one of two ways. In the first two speed construction the motor has a single power element with a commutator and valve capable of converting selected motor chambers to pumping chambers and vice versa. Examples of this type of two speed construction are shown in U.S. Pat. Nos. 3,778,198; 4,480,971; and 4,715,798.

These motors suffer from cavitation problems in the high speed mode. In order for these motors to operate efficiently in the low speed mode, the power element must be designed in such a manner that the conversion of motor chambers to pumping chambers in the high speed mode causes the element to rotate fast enough that cavitation occurs in the fluid. This cavitation causes damage to the motor. In addition, this construction requires an external pilot valve and a pressurized fluid source for shifting between speeds.

The other two speed construction for gerotor-type motors requires two power elements and an external valve for shifting. In the low speed mode the power elements are connected in parallel while in the high speed mode the power elements are connected in series. While this construction does not suffer from the problem of cavitation, it does have a problem with pressure drop. In this construction, the valves which allow the power elements to be switched between parallel and series operation are located outside the motor and are connected to the motor by hoses. This arrangement results in a long travel path and narrow passages for the fluid which powers the power elements.

It is accordingly an object of the present invention to provide a two speed gerotor-type motor which is improved in its ability to operate efficiently at two speeds without cavitation or excess noise and with less pressure drop in the power fluid than in prior art constructions.

It is also an object of the present invention to provide a two speed gerotor-type motor with an improved structure. Still further it is an object to provide such a motor which is compact and reliable.

Another object of the present invention is to provide a two speed construction with a remotely operated valve system integral to the motor. Particularly, it is an object to provide such a system which uses a motor drive fluid for all shifting in order to allow the use of solenoid, manual or automatic control.

Still another object of the present invention is to provide a differential two speed motor option with two independent output shafts capable of independent operation while in parallel mode and locked by fluid pressure when in series mode.

SUMMARY OF THE INVENTION

In accordance with these objects the invention includes first and second gerotor power elements disposed along an axis and separated from each other. Between the first and second power elements and disposed along the axis are first and second commutator plates. The first commutator plate is located adjacent the first power element and has fluid commutator ports extending axially therein to direct fluid to and from the first power element. The second commutator plate is located adjacent the second power element and has fluid commutator ports extending axially therein to direct fluid to and from the second power element. Thus the present invention is a two speed gerotor-type motor of the two power element type.

Located adjacent and axially between the first and second commutator plates is a valve piece. This valve piece forms a structural portion of the motor joining the first and second commutator plates and power elements.

The valve piece contains a valve means for selectively directing fluid flow to said first and second power elements through said first and second commutator plates, respectively, either in series or in parallel. In this manner the valve means allows the fluid flow to be directed so that the motor operates in a low speed mode when the valve directs the fluid in parallel through the power elements and in a high speed mode when valve means directs the fluid in series though the power elements.

Preferably the valve means comprises a spool valve comprising a cylinder formed in said valve piece and having a spool valve piston which moves therein. Also preferably the invention includes first inner and first outer concentric galleries disposed adjacent said spool valve between said spool valve and said ports of said first commutator plate. Second inner and second outer concentric galleries are disposed adjacent said spool valve between said spool valve and said ports of said second commutator plate. The spool valve is connected to a fluid inlet and a fluid outlet of the motor as well as the galleries so that the movement of the spool valve piston in the spool valve cylinder directs the flow of fluid between the inlet and outlet and the galleries.

The location of the valve of the present invention within the motor and directly between the power elements results in a more compact motor and a much shorter flow path. It eliminates the external plumbing of the type used in the prior art two element systems. It reduces the pressure drop and results in a motor which is both sturdy, easy to construct, and reliable. The concentric galleries provide large connection openings between the spool valve and the commutator ports and this also reduces pressure drop.

For a further understanding of the invention and further objects, features and advantages thereof, reference may now be had to the following description taken in conjunction with the accompanying drawings.

DESCRIPTION OF PREFERRED EMBODIMENTS

Figure 1:
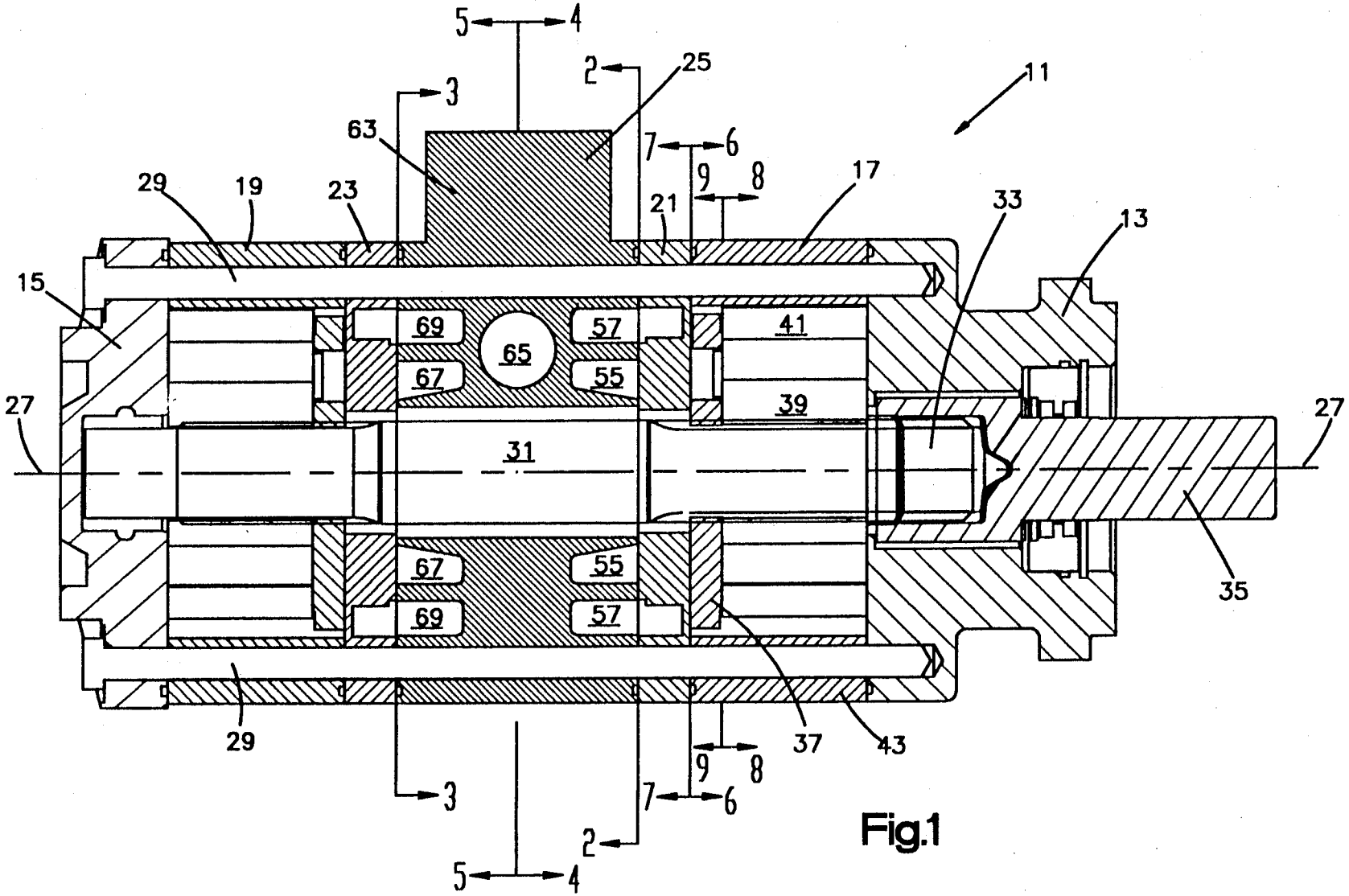
FIG. 1 is a cross-sectional view of the motor of the present invention taken axially through the motor.
Figure 2:
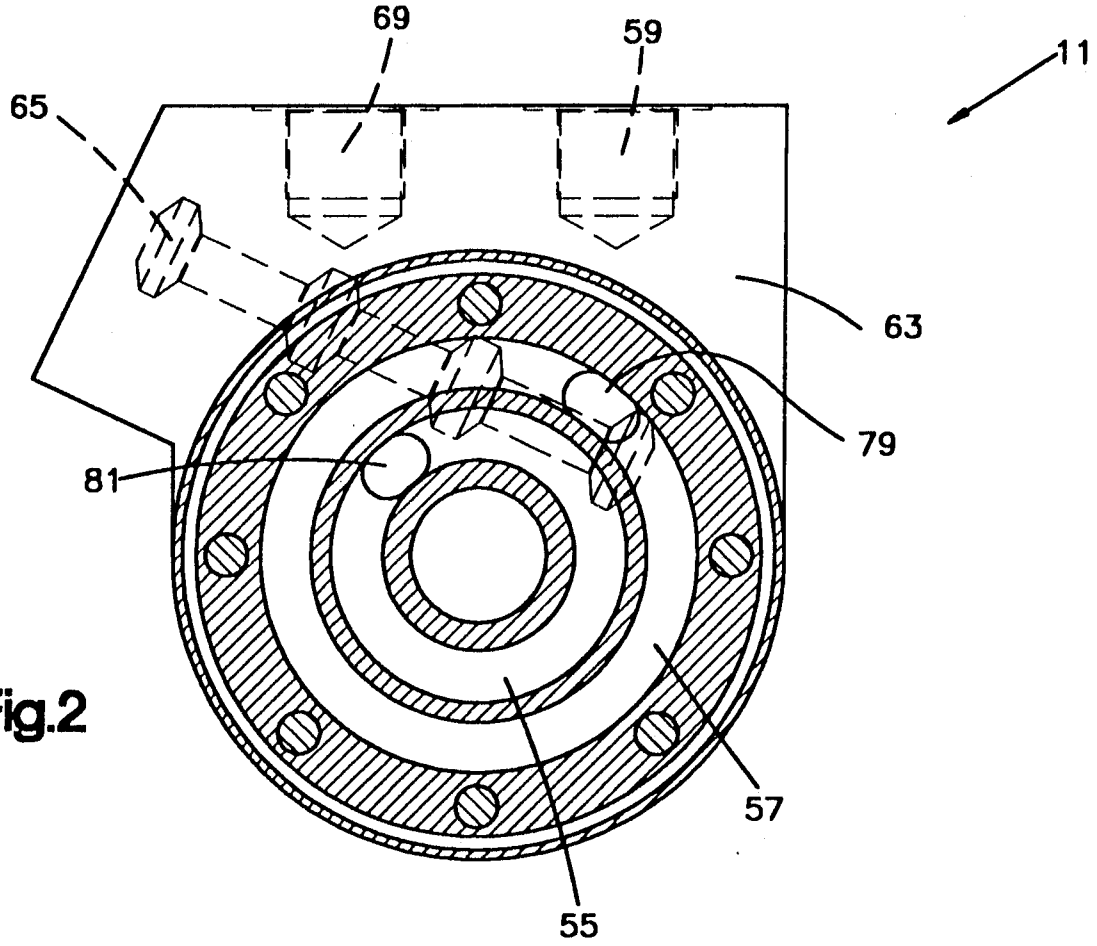
FIG. 2 is a cross-sectional view of the motor shown in FIG. 1 taken along the lines shown in FIG. 1.

Referring now to FIGS. 1 through 9, a motor constructed in accordance with the present invention is shown generally at 11. The motor includes end pieces 13 and 15, power element sections 17 and 19, commutator plates 21 and 23, and a valve piece 25. These portions of the motor are generally cylindrical and extend along an axis 27 so that the motor has a generally cylindrical shape. The motor parts 13 through 25 are held together by bolts 29 which are regularly spaced about the radially outer portion of the motor 11. The bolts extend through each of the parts 15 through 25 and are threaded into end piece 13.

Extending through the motor 11 along the axis 27 is a shaft 31. The shaft 31 is connected by splines to rotate with radially inner pieces of the power element sections 17 and 19. Because the shaft 31 is a single piece, the power element sections 17 and 19 must, therefore, operate so as to rotate together. A splined end 33 of the shaft 31 is connected for rotation with an external shaft 35, also disposed along axis 27 and extending out of the end piece 13. As the power element sections 17 and 19 are hydraulically driven, they rotate the shaft 31 which in turn rotates the external shaft 35. The shaft 35 can be connected to a device outside the motor to which rotational work is desired to be applied by the motor 11.

The power element sections 17 and 19 are mirror images of each other so that a description of the parts of one describes the corresponding parts of the other. However, it is best to position the rotational relation between the power element sections 17 and 19 so that they are out of phase with respect to each other. In other words, the power element timing is such that the power curve of one overlaps the power curve of the other in order to create a damping effect. This can be achieved by rotationally advancing the inner gerotor of one power element section one half lobe ahead of the other. This out of phase rotational relation achieves a smoother, quieter motor operation. The out of phase rotational relation is maintained because the shaft 31 is a single piece.

Although not shown, it is possible to form the shaft 31 of two pieces each having an output end, which is able to rotate separately in parallel (low speed, high torque) mode but each of which is locked by fluid pressure in the series (high speed, low torque) mode. This allows independent rotation in the parallel mode while maintaining the described advantages in the series mode. No gearing or special valving is required since, in series flow, the fluid flow itself will lock the rotation in tandem. A transverse cut through the shaft is all that is required for the separation.

Power element section 17 includes a valve plate 37, an inner gerotor 39, an outer gerotor 41 and a power element housing 43. The valve plate 37 and the inner gerotor each have a splined inner radius which connects with the splined exterior of the shaft 31 so that they rotate together. Rolls 45 are provided on the radially outer portion of the inner gerotor 39 to mate with the inwardly extending gerotor teeth 47 of the outer gerotor. Rollers 49 are provided on the radially inner portion of the power element housing 43 to mate with the openings 51 provided on the radially outer portion of the outer gerotor 41 so that the outer gerotor 41 orbits as it moves between the rotating inner gerotor 39 and the stationary power element housing 43.

Located adjacent the valve plate of each power element section is a commutator plate. Plate 21 is adjacent power element section 17 and plate 23 is adjacent power element section 19. Commutator plate 21 is a mirror image of the commutator plate 23 so that the description the parts of one is a description of the corresponding parts of the other.

The commutator plate 21 has a set of regularly spaced ports 53 extending about the commutator plate 21 in a circle. Each port 53 extends axially through the plate to allow fluid to pass to and from the power element section 17 therethrough. Every other port extends therethrough, however, alternately radially inwardly and radially outwardly so that every other port connects with a radially inner concentric gallery 55 in valve piece 25 and every other port connects with a radially outer concentric gallery 57 in valve piece 25. For example port 53A extends axially through commutator plate 21 to connect to the radially outer concentric gallery 57 while port 53B extends axially through commutator plate 21 to connect to the radially inner concentric gallery 55.

A commutator plate of this construction is described in our copending U.S. patent application Ser. No. 389,657 filed August 4, 1989. The details of its manufacture and the method in which fluid is conveyed to the power element therethrough are described therein and incorporated herein by reference. The manner in which orbiting outer gerotor motors function and the manner in which rotating valve plates selectively deliver the correct pressure fluid to the gerotor sets of such motors are well known in the art of gerotor-type pumps.

The present invention provides an improved means for selectively delivering fluid to the power elements 17 and 19 either in series or in parallel. By in series it is meant that the fluid flow path requires the powering fluid to pass first through one power element and then the other. By in parallel it is meant that the fluid flow path requires the powering fluid to be split into two flows one of which passes through the first power element and the other of which passes through the second power element. The improved means for this selective delivery of fluid to the power elements is disposed in a reliable, compact package; i.e., the valve piece 25.

Referring now particularly to FIGS. 1 through 5, the valve piece 25 has formed therein an inlet 59 and an outlet 61 for the powering fluid to enter and exit the motor 11. The inlet 59 and outlet 61 extend into the valve piece through a raised portion 63 of the valve piece 25. The raised portion 63 of the valve piece extends outwardly from the generally cylindrical shape of the motor 11. Also extending into the raised portion 63 is a spool valve 65.

Concentric galleries 55 and 57 are provided in valve piece 25 adjacent commutator plate 21. In a mirror image fashion, radially inner concentric gallery 67 and radially outer concentric gallery 69 are provided in the valve piece adjacent commutator plate 23. The galleries 67 and 69 function to direct fluid flow to and from the power element 19 through commutator 23 in the same manner that galleries 55 and 57 direct fluid flow to and from power element 17 through commutator 21, as described above.

The spool valve 65 extends into the valve piece 25 between and adjacent the concentric galleries 55 and 57 on one side and 67 and 69 on the other side. By means of connections thereto, the spool valve 65 selectively connects the inlet 59, the outlet 61, and the galleries 55, 57, 67 and 69. In this way the spool valve directs the fluid flow to be either in series or in parallel.

The spool valve includes a spool valve cylinder 71 and a spool valve piston 73. The spool valve cylinder 71 extends longitudinally into the valve piece 25 beneath the inlet 59 and the outlet 61 and between the galleries 55, 57, 67 and 69. An opening 75 connects the inlet 59 to the cylinder 71. An opening 77 connects the outlet 61 to the cylinder 71. An opening 79 connects the gallery 57 to the cylinder 71. An opening 81 connects gallery 55 to the cylinder 71. An opening 83 connects gallery 69 to the cylinder 71. An opening 85 connects gallery 67 to cylinder 71.

Figure 4:
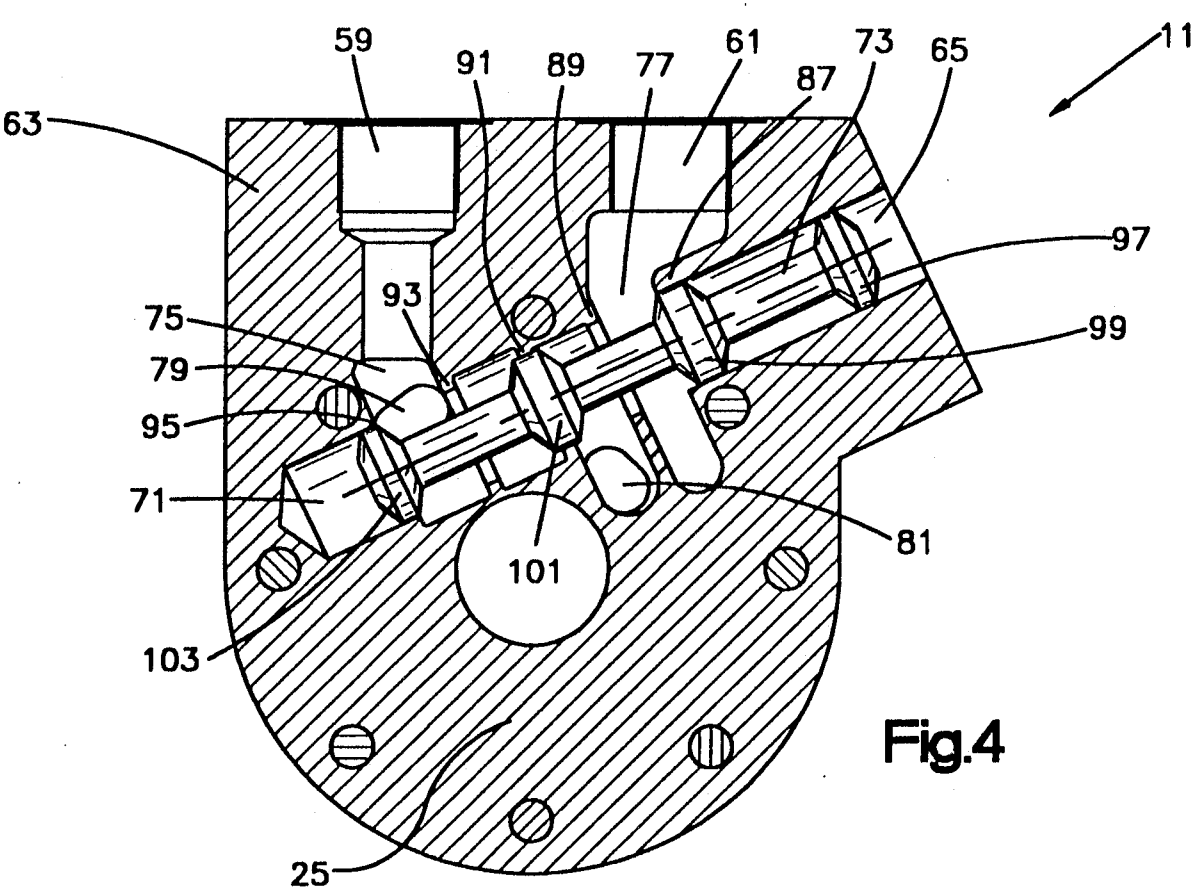
FIG. 4 is a cross-sectional view of the motor shown in FIG. 1 taken along the lines shown in FIG. 1.
Figure 5:
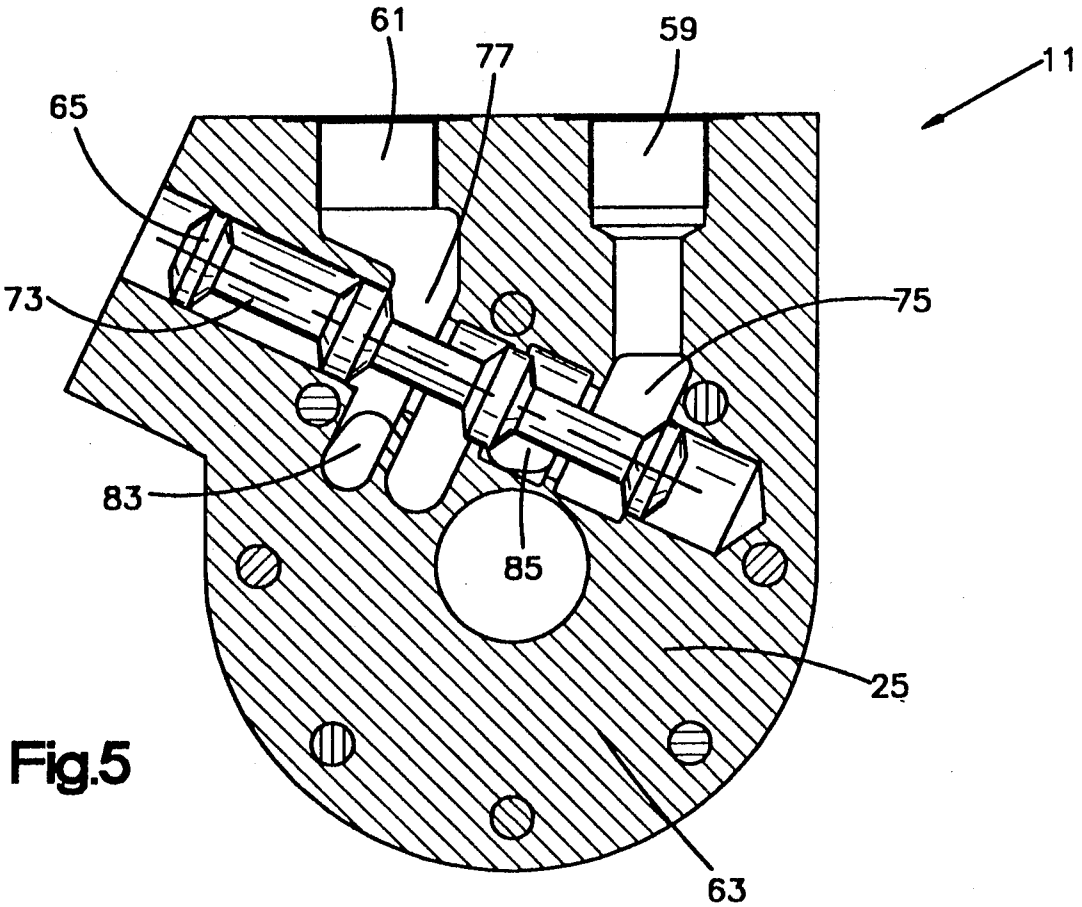
FIG. 5 is a cross-sectional view of the motor shown in FIG. 1 taken along the lines shown in FIG. 1.
Figure 6:
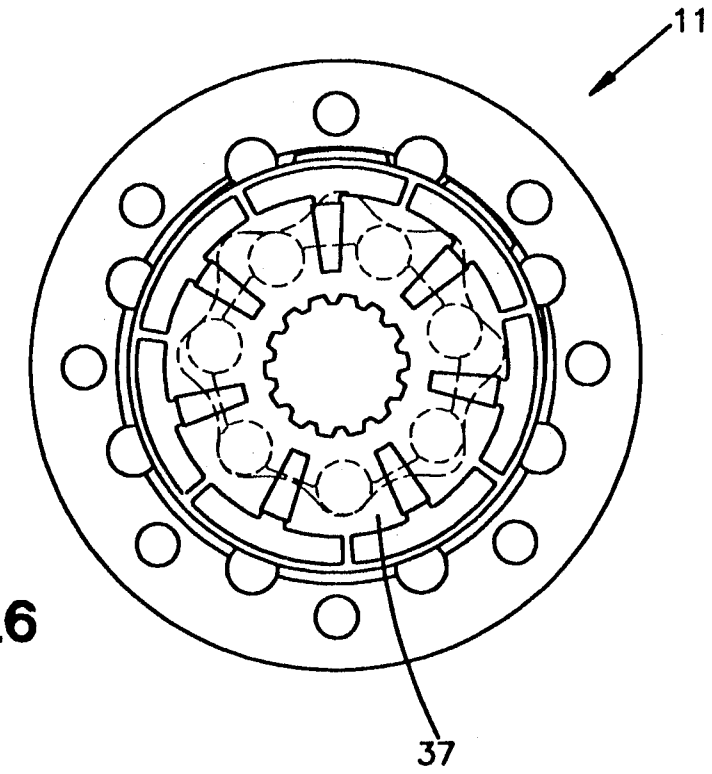
FIG. 6 is a cross-sectional view of the motor shown in FIG. 1 taken along the lines shown in FIG. 1.
Figure 7:
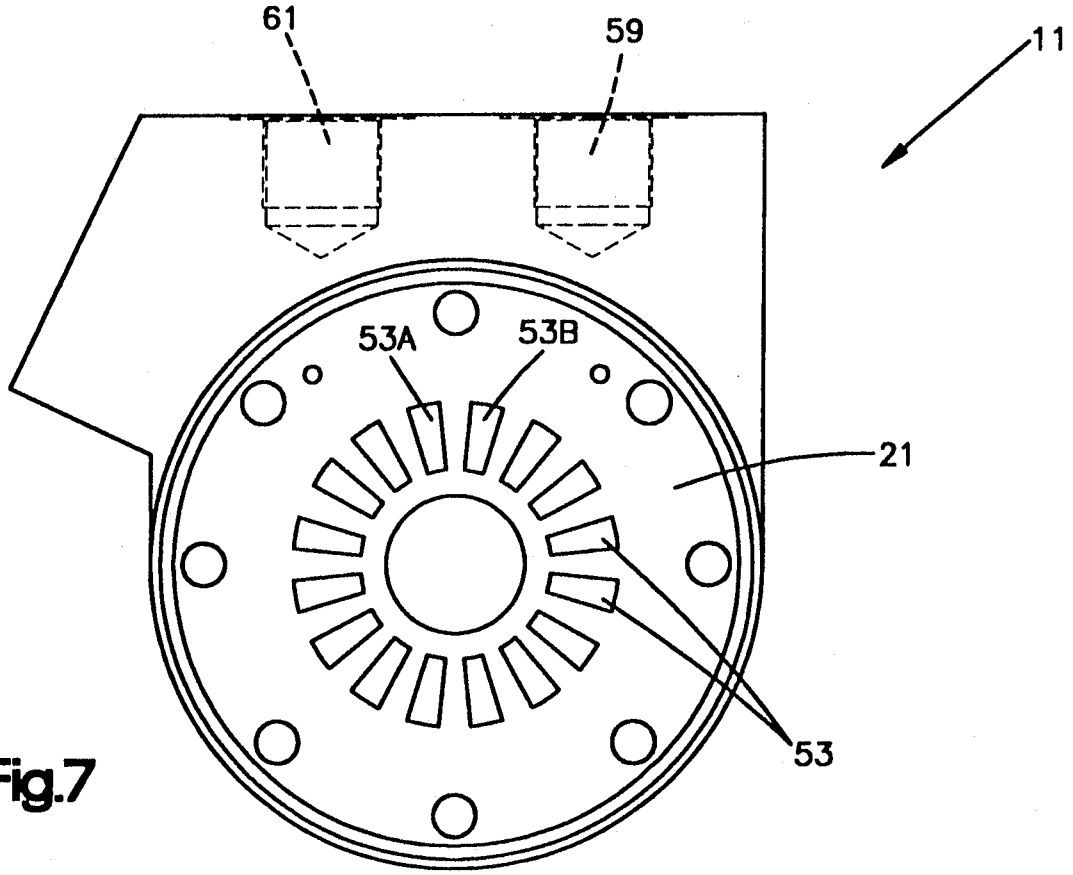
FIG. 7 is a cross-sectional view of the motor shown in FIG. 1 taken along the lines shown in FIG. 1.
Figure 8:
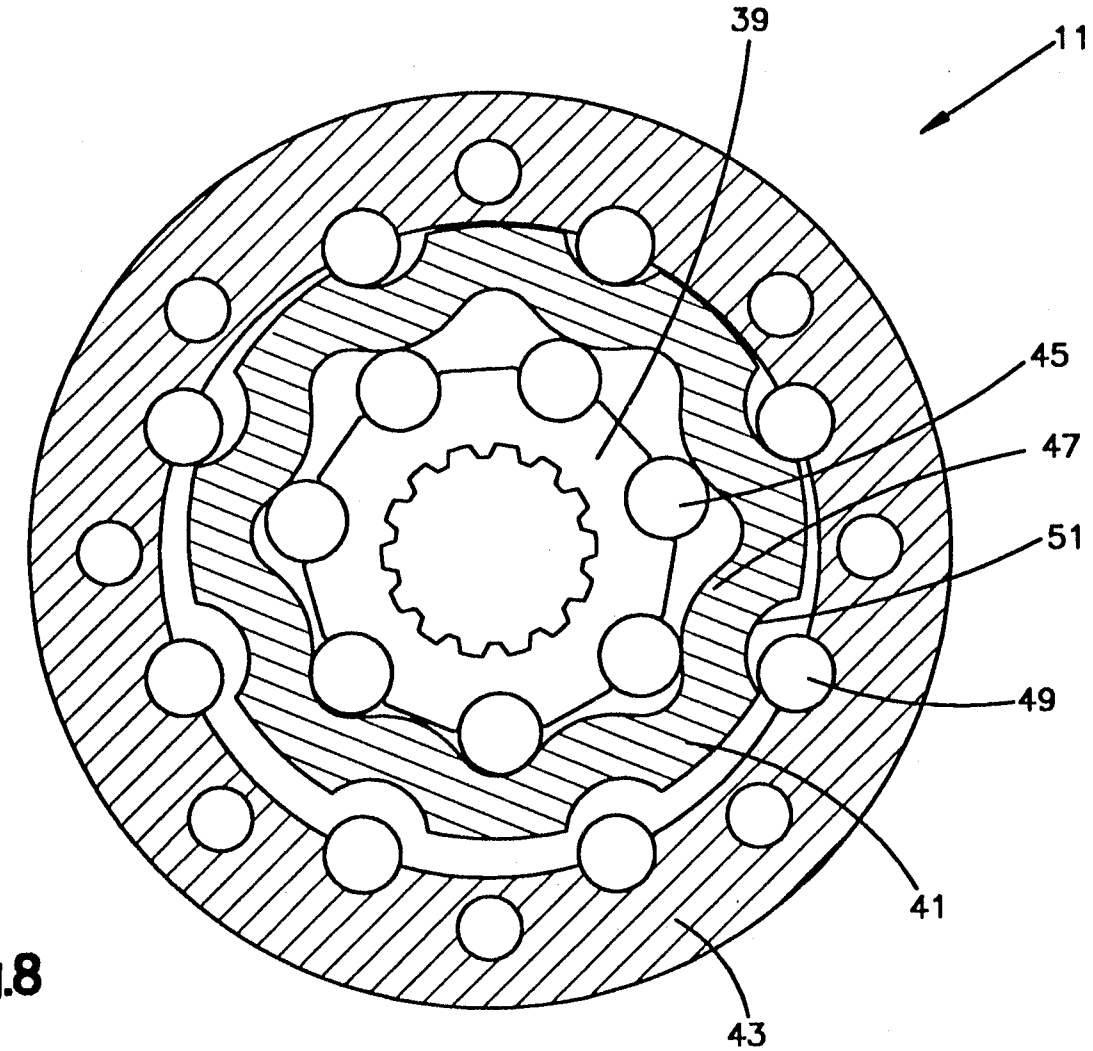
FIG. 8 is a cross-sectional view of the motor shown in FIG. 1 taken along the lines shown in FIG. 1.
Figure 9:
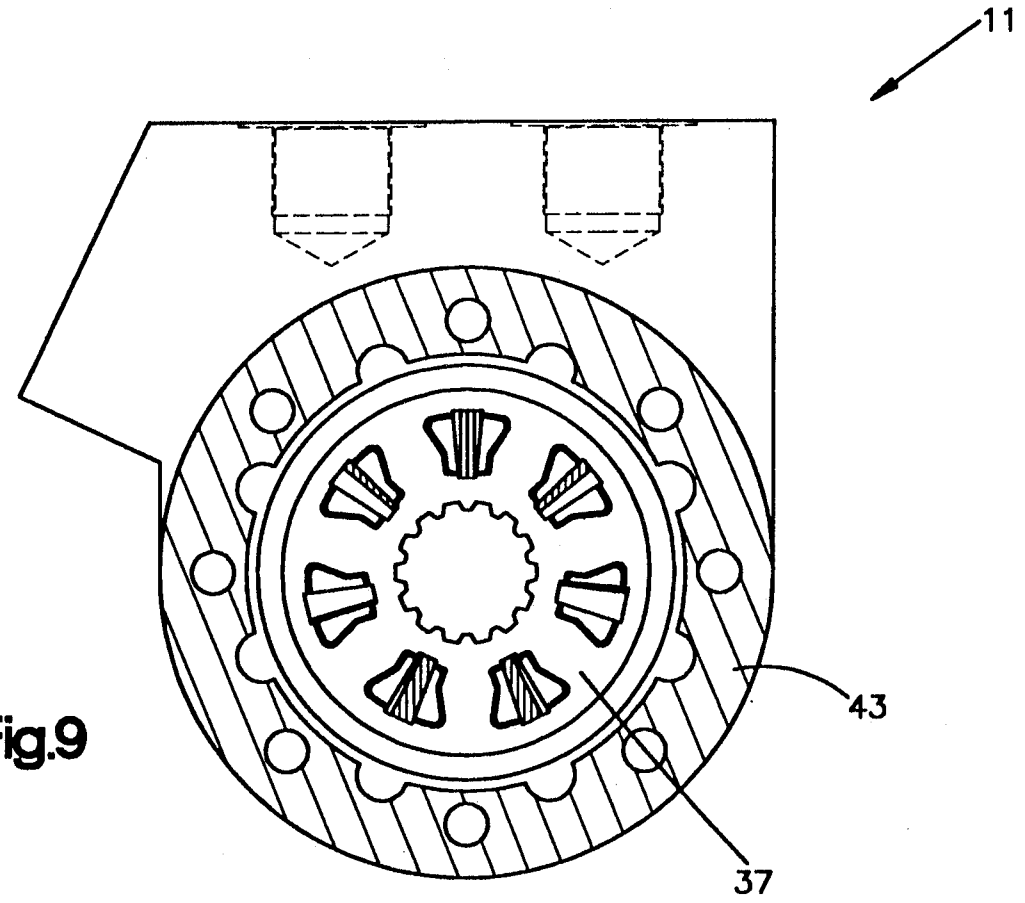
FIG. 9 is a cross-sectional view of the motor shown in FIG. 1 taken along the lines shown in FIG. 1.

As best seen in FIGS. 4 and 5, the cylinder 71 has lands 87, 89, 91, 93 and 95 which define longitudinal segments of the cylinder 71. The four piston heads 97, 99, 101, and 103 sealingly mate with the lands in order to direct flow through the cylinder 71 in such a manner that the power elements receive flow either in parallel or in series, depending on the position of the spool valve piston.

Figure 3:
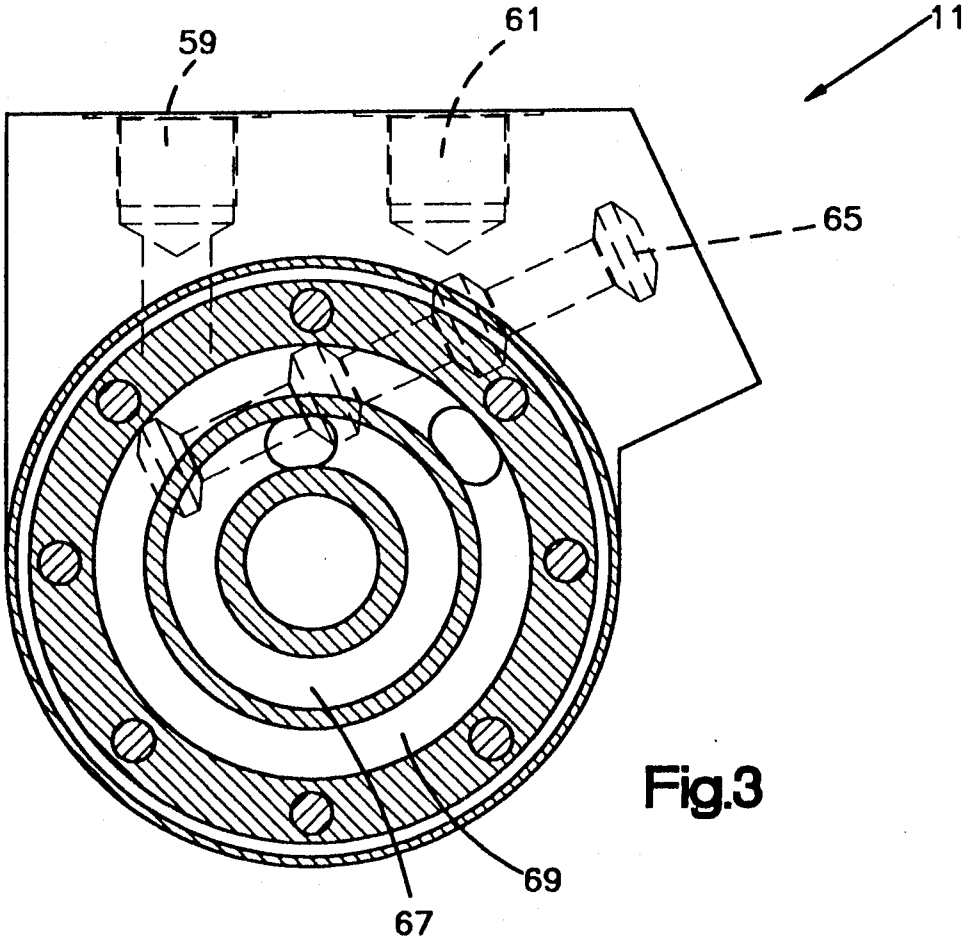
FIG. 3 is a cross-sectional view of the motor shown in FIG. 1 taken along the lines shown in FIG. 1.

As shown in FIGS. 3, 4 and 5, the spool valve piston is positioned for parallel flow to the power elements 17 and 19. Piston head 99 is aligned with land 87, piston head 101 is aligned with land 91 and piston head 103 is aligned with land 95. In this manner, cylinder 71 is divided into a first segment between land 87 and land 91 and a second segment between land 91 and land 95. Flow enters inlet 59, flows into the first segment and into the opening in that segment; i.e., openings 79 and 85. This divides the inlet flow into one path passing into gallery 57 and one path passing into gallery 67. From these galleries the flow passes through the commutator plates and into the pressure sides of the power elements in parallel. Fluid from the discharge sides of the power elements 17 and 19 pass through the commutator plate and into galleries 55 and 69. From these galleries the fluid passes through openings 83 and 81 into the second segment of the cylinder 71. The rejoined discharge flow then exits the motor through outlet 61.

As shown in FIG. 4, the piston 73 can be moved toward the blind end of the cylinder 71 to change the segmentation of the cylinder. This movement can be achieved by a manual or electrical or hydraulic devices connected to the piston (not shown). In this series position of the piston 73, head 97 is aligned with land 87, head 99 is aligned with land 89, and head 101 is aligned with land 93. This divides the cylinder into a first segment between land 87 and land 89, a second segment between land 89 and land 93 and a third segment between land 93 and land 95. Fluid entering inlet 59 enters the cylinder 71 and passes into opening 79, the only opening in the segment between land 93 and land 95. Fluid enters gallery 57 and passes to power element 17 through commutator 21. Discharge fluid from power element 17 passes into gallery 55 through commutator 21. This fluid enters the cylinder segment between land 89 and land 93. Since openings 81 and 85 are in this segment, fluid passes from gallery 55 to gallery 67 through cylinder 71. Fluid then passes into power element 19 through commutator 23. Discharge fluid from power element 19 passes through commutator 23 into gallery 69. From gallery 69 the fluid passes into the segment of cylinder 71 between land 87 and land 89. The fluid then passes out of the motor 11 through the outlet 61. In this manner the fluid passes through the power elements 17 and 19 in series.

It can be seen that the operation of the spool valve 65 in its two positions allows the flow of power fluid in the motor to be easily directed in either series or parallel flow. Large openings and short flow paths are provided. These are provided in a small valve piece 25 which is a structural piece of the motor.

Thus, the present invention is well adapted to achieve the objects and advantages mentioned as well as those inherent therein. It will be appreciated that the end specification and claims are set forth by way of illustration and not of limitation, and that various changes and modifications may be made without departing from the spirit and scope of the present invention.

What is claimed is:

1. A two speed gerotor-type motor comprising:

a first gerotor-type power element disposed along an axis;

a second gerotor-type power element disposed along said axis and axially spaced therefrom;

a first commutator plate disposed adjacent said first power element and disposed axially between said first and second power elements, said first commutator plate having commutator ports extending axially therein to direct fluid to and from said first power element;

a second commutator plate disposed adjacent said second power element and disposed axially between said first and second power elements, said second commutator plate having commutator ports extending axially therein to direct fluid to and from said second power element;

a valve piece disposed adjacent and axially between said first and second commutator plates and structurally joining said first power element and commutator plate to said second power element and commutator plate;

valve means disposed in said valve piece for selectively directing fluid flow to said first and second power elements either in series or in parallel such that said motor can operate at two speeds with a single fluid flow rate and pressure.

2. The motor of claim 1 wherein said valve means comprises:

a spool valve including a spool valve cylinder disposed in said valve piece and having longitudinal segments therein, and a spool valve piston movable in said spool valve cylinder for sealing and selectively separating said longitudinal segments of said spool valve cylinder.

3. The motor of claim 2 which further comprises:

first radially inner and first radially outer concentric fluid passage galleries disposed adjacent said spool valve and adjacent said first commutator plate, each of said galleries being connected to said spool valve by spool valve openings and connected to said commutator ports of said first commutator plate.

* * * * *